United States Patent [19]

Meiry

[11] Patent Number: 4,584,805

[45] Date of Patent: Apr. 29, 1986

[54] MODULAR HOUSE CONSTRUCTION

[76] Inventor: Gad M. Meiry, 175-20 Wexford Ter., Jamaica, N.Y.

[21] Appl. No.: 686,988

[22] Filed: Dec. 27, 1984

Related U.S. Application Data

[63] Continuation-in-part of Ser. No. 467,468, Feb. 17, 1983, abandoned.

[51] Int. Cl.[4] ..... E04B 1/00

[52] U.S. Cl. ..... 52/264; 52/250; 52/274; 52/593; 52/594

[58] Field of Search ..... 52/274, 293, 295, 294, 52/594, 262, 265, 268, 270, 593, 425, 426, 250, 251, 264; 49/19, 21

[56] References Cited

U.S. PATENT DOCUMENTS

| | | | |
|---|---|---|---|
| 1,511,613 | 10/1924 | Joern | 52/250 X |
| 2,324,326 | 7/1943 | Schwendt | 523/250 |
| 2,336,435 | 12/1943 | Zirinsky | 52/293 X |
| 2,372,042 | 3/1945 | Yankee | 52/426 |
| 3,023,463 | 3/1962 | Bigelow, Jr. | 52/264 X |
| 3,193,973 | 7/1965 | Lee et al. | 52/90 X |
| 4,306,372 | 12/1981 | Lin | 46/19 |
| 4,416,097 | 11/1983 | Weir | 52/594 X |

FOREIGN PATENT DOCUMENTS

| | | | |
|---|---|---|---|
| 202489 | 3/1966 | Sweden | 52/274 |

*Primary Examiner*—Carl O. Friedman
*Attorney, Agent, or Firm*—Ilya Zborovsky

[57] ABSTRACT

A house includes a floor, side walls and a ceiling which are prefabricated, assembled with each other with the aid of interengaging formations in form-locking manner, and the walls are provided with inner hollow spaces filled by a filling material. A roof can also be engaged with the ceiling. No connecting or fastening elements are needed. The house can be built as a multistorey structure.

20 Claims, 13 Drawing Figures

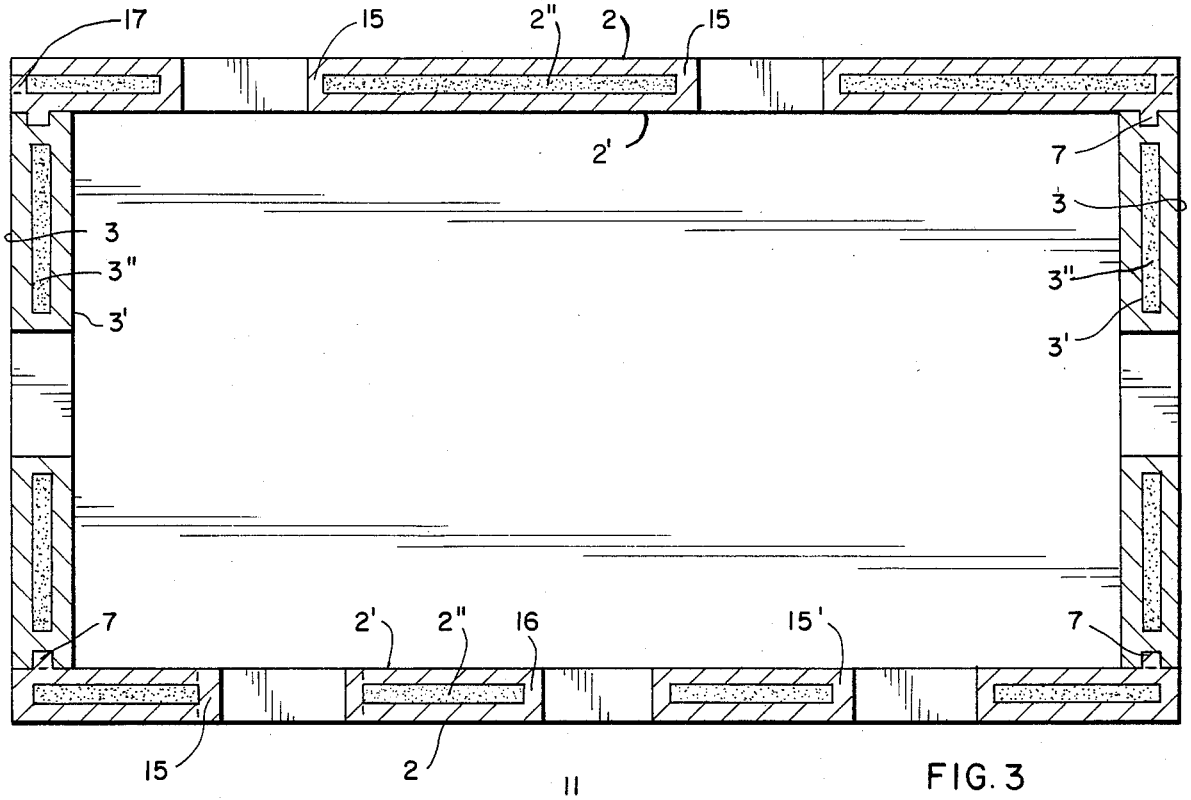
FIG. 3
FIG. 8
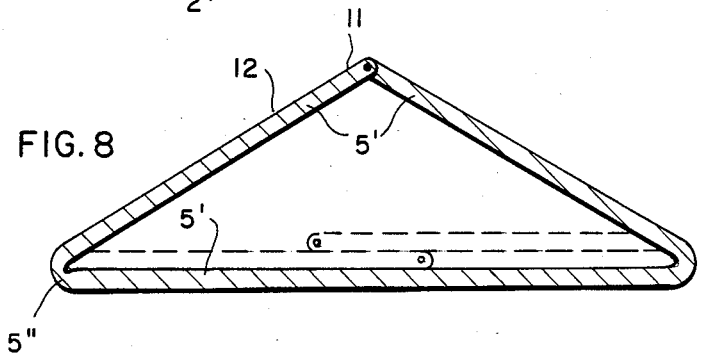
FIG. 9
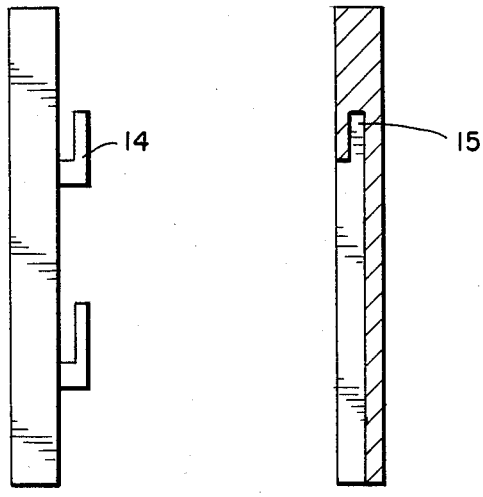

MODULAR HOUSE CONSTRUCTION

CROSS REFERENCE TO A RELATED APPLICATION

This application is continuation-in-part of application Ser. No. 467,468, filed on Feb. 17, 1983 abandoned Apr. 24, 1985.

BACKGROUND OF THE INVENTION

The present invention relates to a house. The term "house" is used here to identify a living unit of any shape and for any application.

Construction industry erects houses with use of conventional materials and construction technique. One of the main problems is to erect houses with a very high speed, with low costs, and at the same time sufficient service life. Existing houses possess some disadvantages in the sence of the requirements which are mentioned hereinabove. In condition of increasing demand for housing throughout the world, the speed of construction and the cost of houses are of great importance. All known houses have walls, floors, ceilings etc which are connected with one another in a complicated way and always with use of special connecting and fastening elements. This increases the cost of manufacture and assembling of such houses and makes their erection rather difficult.

SUMMARY OF THE INVENTION

Accordingly, it is an object of the present invention to provide a house which avoids the disadvantages of the prior art. It is also an object of the present invention to provide a method of making a house, which avoids the disadvantages of the prior art.

More particularly, it is an object of the present invention to provide a house and a method of making the same, in accordance with which the house has a relatively low costs, can be erected fast, and has a sufficient service life.

In keeping with these objects and with others which will be apparent hereinafter, one feature of the present invention resides, briefly speaking, in a house in which a floor element, a ceiling element and wall elements have engaging formations formed so that said elements can be connected with one another by interengagement of the respective formations in form-locking manner.

The novel features of the present invention are set forth in particular in the appended claims. The invention itself, however, will be best understood from the following description of preferred embodiments which is accompanied by the following drawing.

BRIEF DESCRIPTION OF THE DRAWING

FIG. 3 is a view showing a section taken along the line III—III in FIG. 1;

FIG. 8 is a view showing a section of a roof of the inventive house;

FIG. 9 is a view showing a portion of a wall with connecting members, and part of a coating to be connected to the wall of the inventive house.

DESCRIPTION OF PREFERRED EMBODIMENTS

Figure 1:
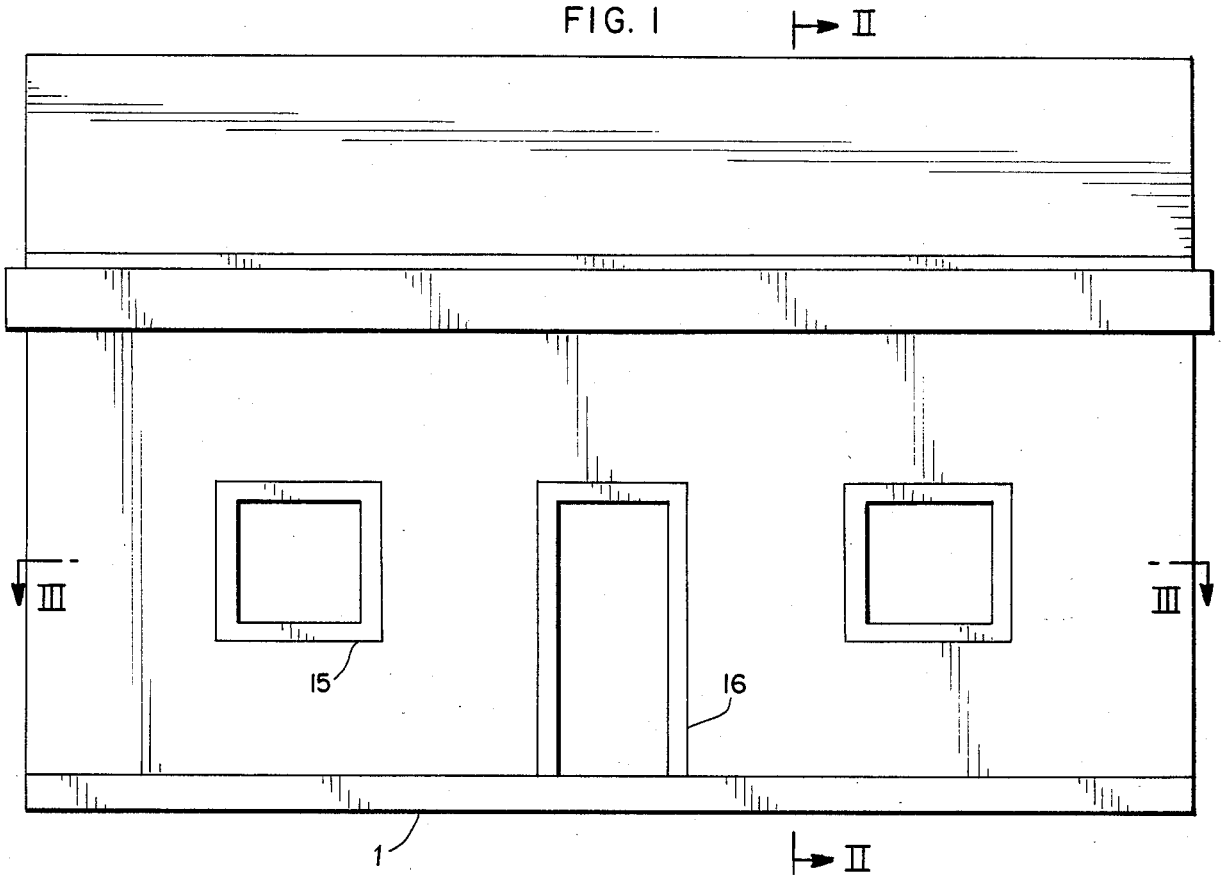
FIG. 1 is a front view of a house in accordance with the present invention.
Figure 2:
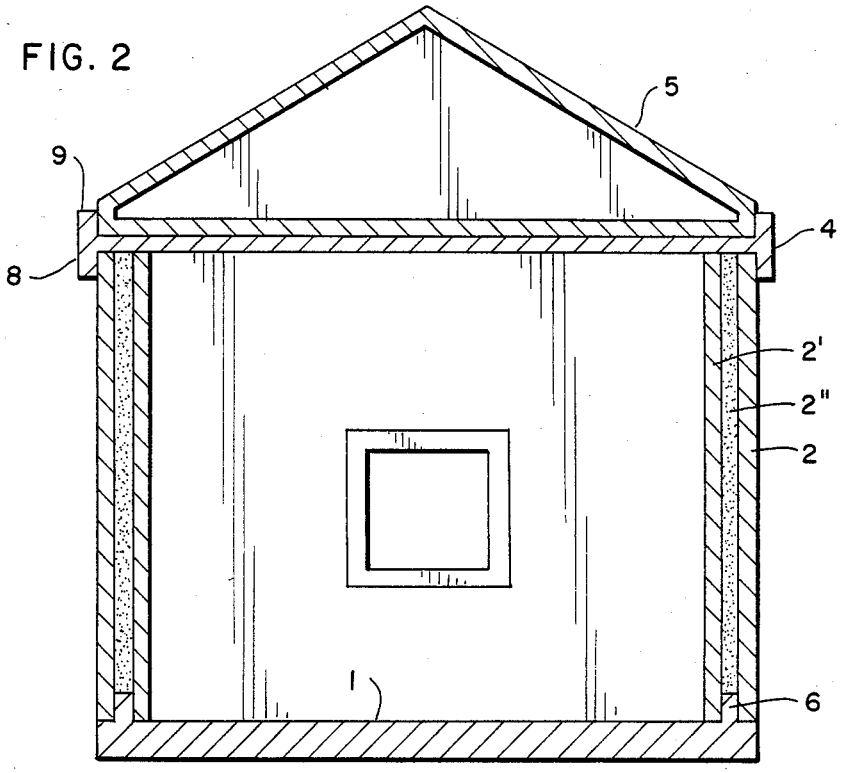
FIG. 2 is a view showing a section of the inventive house taken along the line II—II in FIG. 1.

A house in accordance with the present invention is shown in front view in FIG. 1, in a side view in FIG. 2, and in a plan view in FIG. 3. The house has a floor identified by reference numeral 1, two long side walls identified by reference numeral 2, two short side walls identified by reference numeral 3, a ceiling identified by reference numeral 4, and a roof identified by reference numeral 5.

Each of the walls 2 and 3 is composed of two wall portions identified by reference numerals 2' and 3' respectively, and spaced from one another so as to define a hollow space therebetween. A filling material is accommodated in this hollow space. The wall portions can be composed of fiberglass, plastic, styroform, pressed wood, aluminum sheets and other materials. The filling material can be mud, soil, slug, cement, industrial waste and other materials. A binder can be added to the filling material, but is not absolutely necessary. The filling material which fills the hollow spaces inside the side walls 2 and 3 is identified with reference numerals 2'' and 3'', respectively.

The above mentioned parts of the inventive house are provided with engaging formations arranged so that the parts can be connected with one another in a form-locking manner. As can be seen from FIG. 1, the floor 1 has projections 6, wherein the long side walls 2 have recesses in which the projections 6 engage. These recesses can be formed by downwardly open hollow spaces between the wall portions 2'. On the other hand, if the hollow spaces between the wall portions 2' are closed from below, special recesses can be provided for engagement of the projections 6 into the same. The same is true with respect to the short side walls 3. The floor 1 is provided with projections extending along its short sides, and the short side walls 3 have recesses in which these projections engage.

It is to be understood that other solutions for the above described form-locking connection between the side walls and the floor is possible, For example, the floor 1 can be provided with grooves, while the side walls 2 and 3 can be provided with projections engageable in such grooves. It is also possible to have projections on some side walls engageable into grooves of the floor, and grooves in other side walls for engagement by projections of the floor.

The side walls 2 and 3 also have formations for their connection with one another. As can be seen from FIG. 3, the long side walls have projections 7 extending normal to the direction of elongation of the respective long side wall. Each of the short side walls has recesses at its two ends facing the long side walls. The projections 7 of the long side walls 2 engage into the recesses of the short side walls 3 in form-locking manner. It is to be understood that the short side short walls can be provided with the projections, whereas the long side walls can be provided with recesses. It is also possible to provide some short walls or long walls with the projections, and other short walls or long walls with the recesses.

The ceiling 4 has a projection 8 extending downwardly from the former. The projection 8 can run along the entire contour of the ceiling 4 and is formed so that when the side walls 2 and 3 are assembled with each other and the ceiling 4 is fitted from above onto the upper edges of the side walls 2 and 3, the projection 8 tightly embraces the walls and holds them together so that they cannot move apart from one another. The ceiling 4 is also provided with a projection 9 extending upwardly from the former. The projection 9 can also extend over the entire contour of the ceiling and is formed so that when the roof 5 is placed onto the ceiling, the projection 9 tightly embraces the roof 5 thus preventing its displacement in a horizontal direction.

Figure 4:
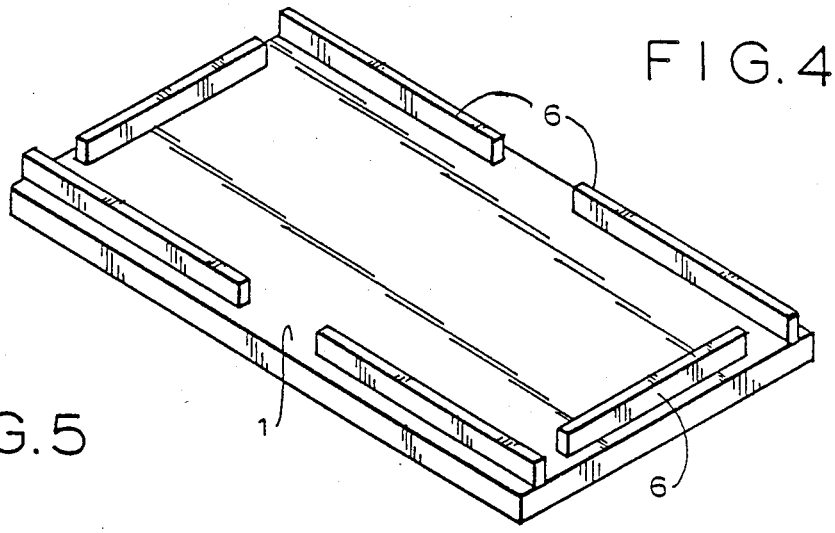
FIG. 4 is a perspective view showing a floor element of the inventive house.
Figure 5:
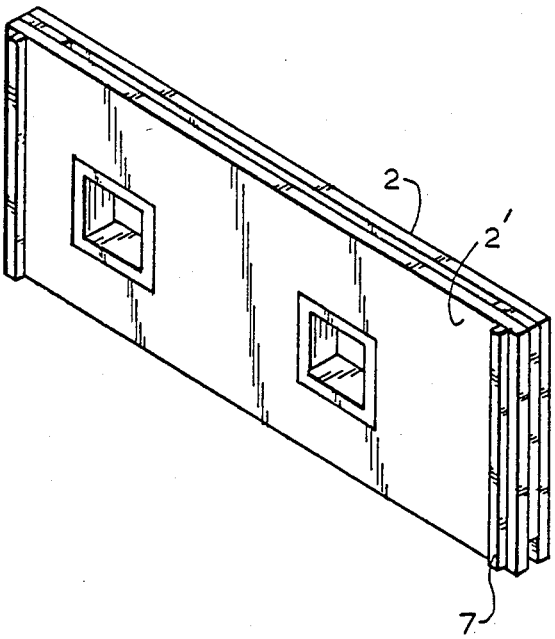
FIG. 5 is a perspective view showing a front wall of the inventive house.

The ceiling 4 together with the projections 8 and 9 can be formed as a one piece member. It is however also possible to form the ceiling 4 separately and to then attach to it two vertical members each forming one of the projections 8 and 9, or one vertical member which simultaneously forms two projections, as shown at the left side of the ceiling in FIG. 2. Similarly, the side walls 2 and 3 can be formed of one piece with their projections, or alternatively by two separate parts as shown in broken lines in the left lower corner in FIG. 3. Finally, the projections of the floor 1 can also be formed by separate parts attached to the floor. FIGS. 4 and 5 show the projections formed by separate parts attached to the floor and the long side walls.

Figure 6:
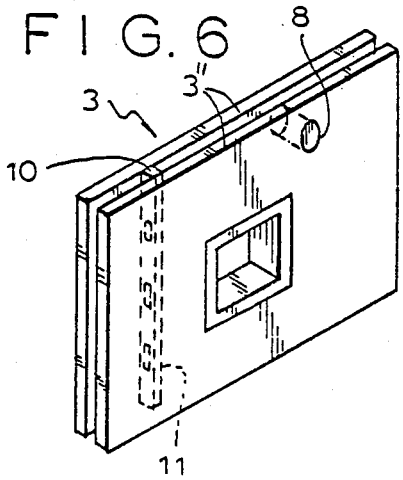
FIG. 6 is a perspective view showing a side wall of the inventive house.
Figure 7:
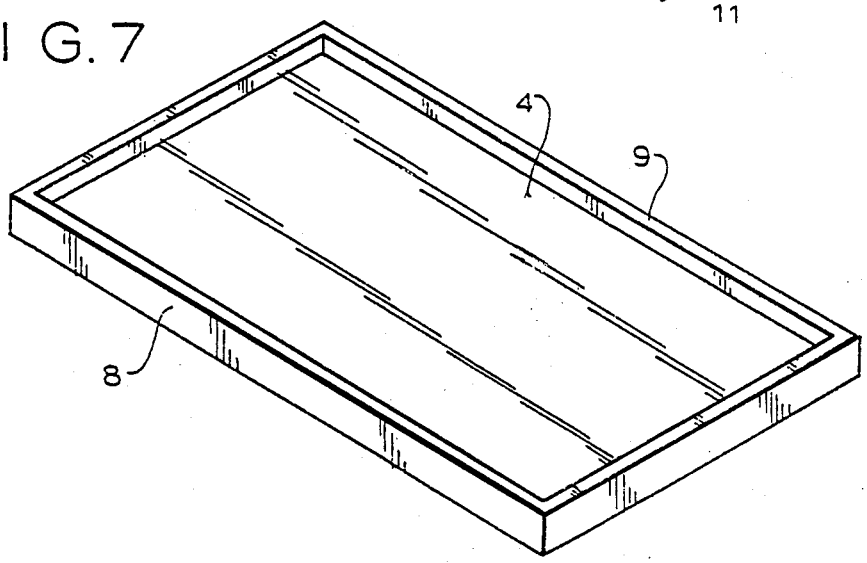
FIG. 7 is a perspective view showing a ceiling of the inventive house.
Figure 11:
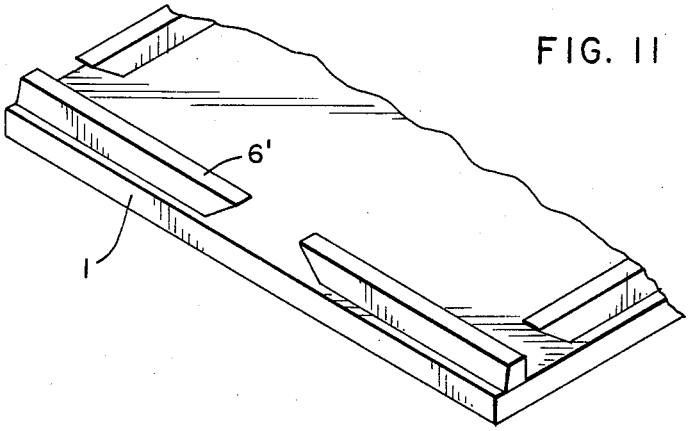
FIG. 11 shows another embodiment of the floor element.

As can be seen from FIG. 6, partitions 10 can be provided inside the wall portions of the respective side walls to connect the wall portions with one another and to subdivide the hollow inner space into a plurality of compartments. The partitions 10 can be of one piece with the wall portions or formed by separate parts. The partitions are provided with through opening 11 to facilitate filling of the hollow spaces by the filling material.

FIG. 8 shows the roof 5 of the inventive house. It is composed, for example of three portions 5'. The side roof portions can be connected with the bottom roof portion by a flexible hinge formed by an intermediate section 5'' of a reduced cross section. The two side roof portions can be connected with one another, for example, by a conventional hinge including alternating loops 12 provided in these portions and a pin 13 insertable into the loops. The roof 5 is shown in a working or elevated position. When the pin 13 is withdrawn, the portions 5' can be folded so that the roof becomes substantially flat for transportation and storage as shown in broken lines in FIG. 8. The roof ceiling and floor can be subdivided in direction of their width into a plurality of portions which can be assembled by interengaging projections and grooves. This makes convenient their transportation in tunnels, low structures etc.

FIG. 9 shows that the inventive house can be provided with a coating. For this purpose the walls can have hooks 14, and parts 15 of the coating can be hung on the hooks by their recesses. The coating can be formed as aluminum siding, plastic siding, wooden coating etc. It is to be understood that other methods of connecting the coating with the walls are also acceptable.

The window and door frames can be formed of one piece with the respective walls as identified by reference numerals 15 and 16. However, it is also possible to make these frames as separate parts and later insert the same into the respective openings of the walls. This is identified by reference numeral 15' in FIG. 3. When the wall portions of the respective walls are separate parts to be connected with one another, the hollow space between the wall portions can be closed by end pieces as identified by reference numeral 17. The wall portions can also be connected with one another by pin-like connecting elements 18.

The house in accordance with the present invention can be erected in the following manner. The construction begins with digging a deep trench. Then the floor is installed and the walls are lowered and engaged with the floor and with each other in form-locking manner with the aid of the respective engaging formations. At this stage, a part of soil or rocks and then soil will be placed in the middle of the house and levelled about one foot below the door-saddle. This soil is placed inside the house in a wetted condition, preferably with the aid of a cement mixer. When the soil has dried sufficiently and the floor has settled, a floor cover is put in place and secured. Sand or other material is filled into the remaining space and tiles or other floor cover is placed to the saddle level of the door. Then, another portion of the soil is prepared in the mixer and poured into the hollow spaces in the walls of the house. The soil is allowed to dry before placing the ceiling onto the walls. Then the ceiling is placed onto the walls, and the roof is placed onto the ceiling if necessary. Thus, all parts of the house are prefabricated, they are brought to a construction site, assembled with one another in form-locking members, the hollow walls are filled with the filling material, and their outer surfaces can be coated. Windows, doors, toilets, kitchen fitting etc are also prefabricated. The parts of the house can also be formed with extensions which form verandas, balconies etc.

The thus designed and made house is inexpensive, simple in construction, easy to manufacture and construct at the site. It can floods, winds, earthquakes, to some extent fires, extreme heat, and extreme cold.

Figure 10:
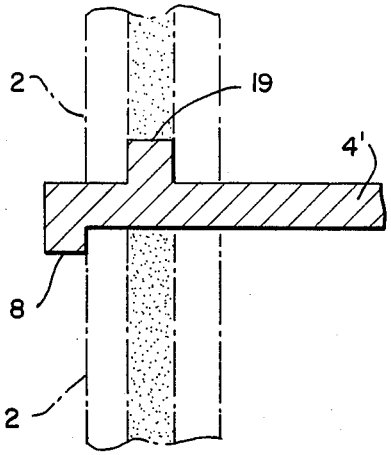
FIG. 10 is a view showing the ceiling element of the inventive house in accordance with another embodiment of the invention.

FIG. 10 shows a ceiling element in accordance with another embodiment of the invention. The ceiling element identified with reference numeral 4' is provided not only with the projection 8 on its upper surface, but also with a plurality of projections 19 which are arranged on its upper surface and are formed similar to the projections 6 on the floor element 1. The projections 19 are located inwardly of the projection 8. When such a ceiling element 4' is placed on the walls and retains them from moving in a horizontal plane, another set of similar walls can be placed onto the ceiling element and their spaces can be engaged over the projections 19. Thereby, at least two-storey house can be build. With the ceiling elements 4' houses of many storey can be build as well.

As in the house shown in the previous Figures, and also in the multi-storey house, all the elements of the house are connected with one another with engaging projections and grooves, so that additional connecting and fastening elements are not needed.

As can be seen from the drawing, gaps are provided between the projections 6 of the floor element 5. These gaps are very important since the filling material in such constructions fills the spaces between the wall portions of each wall to the upper surface of the projections, but also move downwardly into the gaps to the upper surface of the floor. After solidification of the filling material in the spaces inside the walls and in the gaps between the projections, the connection of the walls with the floor becomes firmer and more reliable.

FIG. 1 shows that the gaps between projections 6' of a floor 1' can be formed with a cross section increasing towards the floor, possibly of a dove-tail shape. When the filling material solidifies in the thus formed gaps, the connection becomes further firmer.

Figure 12:
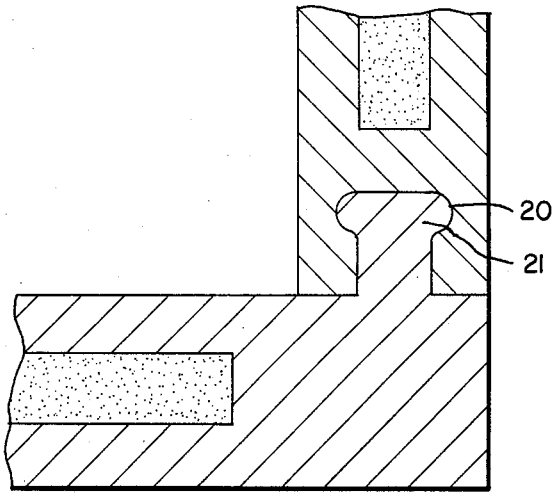
FIG. 12 is a view showing another embodiment of the wall corner area.

FIG. 12 shows on an enlarged scale the lower right corner of FIG. 3. Here the projection of one wall is formed with lateral protrusions 21, and the groove of the neighboring wall is formed with corresponding recesses 20. This provides an undercut preventing withdrawal of the walls from one another after assembling. Such formations make the connection especially strong. When the walls are formed of plastic, fiberglass and other elastic materials, the protrusions 21 can elastically yield during assembling and transverse engagement of one wall into the other. With the rigid materials for the walls, when the protrusions are not yieldable. The walls are assembled with one another by sliding the projections into the grooves from the end of the grooves along the latter.

Figure 13:
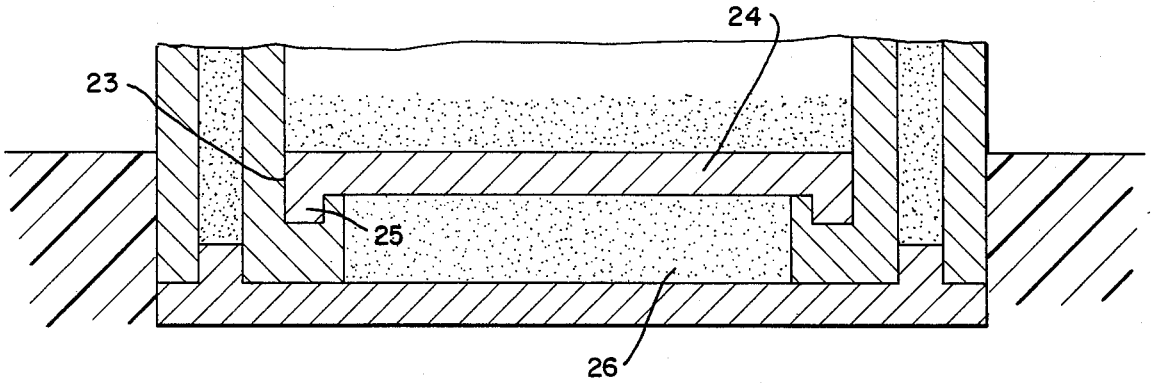
FIG. 13 shows another embodiment of the floor area of the house.

FIG. 13 shows a further modification of the floor area of the inventive house. The walls are provided with an additional formation 22 which forms an additional groove 23. An additional floor plate 24 are further provided. It has a projection 25 engaging into the groove 23 of the wall at the respective side. The house is arranged in the ground down to the level of the floor plate, so as to be firmly anchored in the ground. Sand or another material can then be placed onto the floor plate, and on the top of the sand layer a floor covering can be provided. A ballast 26 fills the space under the plate. The house in accordance with the invention provide for a possibility to be inexpensively manufactured and then assembled easy and inexpensive in any area. It can be built with or without, its roof, floor plate and other features. It can be one- or multi-storey. It uses local materials as a filler. It is assembled as easy as a shoe box or a toy house.

The invention is not limited to the details shown since various modifications and structural changes are possible without departing from the invention.

What is desired to be protected by Letters Patent is set forth in the appended claims.

I claim:

1. A house, comprising a one-piece floor element having a plurality of projections; a plurality of wall elements each composed of two substantially parallel one-piece wall portions each having upper and lower ends and forming therebetween a through-going uninterrupted space extending between and open at said both ends, so that when said wall elements are placed onto said floor element said projections of said floor element form-lockingly engage into said spaces of said wall elements at said lower ends, and a filling material introduced into said spaced of said wall elements through said upper ends so as to move downwardly through said through-going uninterrupted spaces over their entire height on situ to said lower ends and downwardly onto said respective projections of said floor elements; and a one-piece ceiling element having a further projection engageable over said wall element so as to surround the latter at said upper ends, said projections of said floor element vertically engaging into said spaces of said wall elements at said lower ends whereas said projection of said ceiling element engaging over and surrounding said wall elements at said upper ends so as to prevent movement of said wall elements in a substantially horizontal direction both at said lower ends and at said upper ends of said wall elements respectively and to retain said wall elements together, said plurality of wall elements including a first group of wall element having lateral projections and a second group of wall elements having lateral grooves and arranged so that said wall elements are connected with one another by interengaging lateral grooves and projections, whereby said ceiling element, said wall elements, and said floor element are connected with one another only by the respective projections engaging in the respective grooves without fastening elements.

2. A house as defined in claim 1, wherein said filling material is mud.

3. A house as defined in claim 1, wherein said filling material is slug.

4. A house as defined in claim 1, wherein said filling material is cement.

5. A house as defined in claim 1, wherein said filling material is an industrial waste.

6. A house as defined in claim 1, wherein said floor element is formed of one piece with said projections engageable into said spaces of said wall elements.

7. A house as defined in claim 1, wherein said ceiling element has an outer contour, said further projection extending over the entire outer contour of said ceiling element and is formed on one piece with the latter.

8. A house as defined in claim 1 and further comprising a roof element, said ceiling element having upper and lower sides, said further projection being provided at said lower side of said ceiling, said formations also including an additional projection provided at said upper side of said ceiling element and forming a recess arranged so that said roof element can be at least partially received in said recess.

9. A house as defined in claim 1, wherein said ceiling element, said further projection and said additional projection are formed of one piece with one another, so as to form together a one-piece element.

10. A house as defined in claim 1, and further comprising a roof element including a plurality of roof portions hingedly connected with one another and movable between an unfolded position in which they make an elevated structure and a folded position in which said ceiling is substantially flat.

11. A house as defined in claim 10, wherein at least two of said roof portions have an intermediate flexible section therebetween so as to enable said two roof portions to move between said unfolded and folded positions.

12. A house as defined in claim 1; and further comprising a coating arranged on said wall elements at their outer side facing outwardly of the house.

13. A house as defined in claim 1; and further comprising at least one second plurality of such wall elements, said ceiling element having two surfaces facing away of one another, said further projection being arranged on one of said surfaces, whereas the other of said surfaces is provided with a plurality of ceiling projections which are similar to said projections of said floor element and engagable into said spaces of said wall elements of said second plurality so as to form at least two-storey house.

14. A house as defined in claim 13, wherein said ceiling projections are located on said ceiling element inwardly of said further projection and formed of one piece with said ceiling element, said further projection being also formed of one piece with said ceiling element.

15. A house as defined in claim 14, wherein said first-mentioned projections are formed of one piece with said floor element, said additional projections being formed of one piece with said wall elements, so that all said projections are formed of one piece with the respective elements.

16. A house as defined in claim 1, wherein said projections of said floor element are arranged so that a plurality of gaps are formed therebetween, so that the filling material moves in said spaces between said wall portions of said wall elements not only to an upper surface of said projections, but also between said projections into said gaps to an upper surface of said floor element, so as to more firmly connect said wall elements with said floor element.

17. A house as defined in claim 16, wherein said gaps between said projections have a cross section which increases in direction towards said floor element, to improve connection between said wall elements and said floor element.

18. A house as defined in claim 1, wherein at least some of said wall elements have lateral formations provided with lateral grooves; and further comprising a floor plate having floor plate projections which engage in said lateral grooves of said wall elements so that said floor plate are held upwardly at a distance from said floor element.

19. A house as defined in claim 18, wherein said floor plate are arranged so that a space is formed between said floor plate and said floor element, said space being filled with a ballast material.

20. A house as defined in claim 1, wherein said lateral projections of said wall elements of said first group have protrusions, while said lateral grooves of said wall elements of said second group have recesses in which said protrusions engage.

* * * * *